US007823813B2

(12) United States Patent
Galloway et al.

(10) Patent No.: US 7,823,813 B2
(45) Date of Patent: Nov. 2, 2010

(54) LOWER FEED STOP BAR

(75) Inventors: Edwin N. Galloway, Pella, IA (US); Jeffrey D. Bradley, Pella, IA (US); James L O'Halloran, Pella, IA (US); Eric L Baker, Reasnor, IA (US)

(73) Assignee: Vermeer Manufacturing Company, Pella, IA (US)

( * ) Notice: Subject to any disclaimer, the term of this patent is extended or adjusted under 35 U.S.C. 154(b) by 1030 days.

(21) Appl. No.: 11/534,077

(22) Filed: Sep. 21, 2006

(65) Prior Publication Data

US 2008/0135653 A1 Jun. 12, 2008

(51) Int. Cl.
*B27K 7/00* (2006.01)
*B27L 11/00* (2006.01)
*D21D 1/30* (2006.01)

(52) U.S. Cl. ..... 241/28; 241/34; 241/36

(58) Field of Classification Search ..... 241/28, 241/34, 30, 36, 92

See application file for complete search history.

(56) References Cited

U.S. PATENT DOCUMENTS 5,692,548 A 12/1997 Bouwers
5,692,549 A 12/1997 Eggers
6,293,479 B1 * 9/2001 Kaczmarski et al. ..... 241/92
7,011,258 B2 * 3/2006 O'Halloran et al. ..... 241/28
7,044,409 B2 * 5/2006 Stelter et al. ..... 241/28
7,121,488 B1 * 10/2006 Marriott et al. ..... 241/92
2002/0070301 A1 * 6/2002 Stelter et al. ..... 241/36
2004/0108397 A1 6/2004 O'Halloran
2007/0001038 A1 * 1/2007 Bouwers et al. ..... 241/34
2007/0267526 A1 * 11/2007 Uhrich et al. ..... 241/30

OTHER PUBLICATIONS 4 pages of a color brochure entitled Brush Chipper—BC1800XL by Vermeer, dated 2003.

* cited by examiner

*Primary Examiner*—Bena Miller
(74) *Attorney, Agent, or Firm*—Sturm & Fix LLP

(57) ABSTRACT

A control mechanism for the feed of a brush chipper is disclosed. A lower feed stop bar, located under a feed table, pivots on a pivot axis located below and toward the brush chipper from the control bar of the lower feed stop bar. The center of gravity of the lower feed stop bar, then, tends to pivot the lower feed stop bar away from the feed disengage position. Hence, nuisance trips due to vibration, impact of brush on the table, etc., are reduced.

11 Claims, 8 Drawing Sheets

LOWER FEED STOP BAR

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention relates to feed control for a brush chipper. More particularly, the invention relates to a method and apparatus for providing a lower feed stop bar that reduces nuisance trips.

2. Background Art

Control aspects of brush chippers are provided for control and safety of machinery and operators. One control aspect, a lower feed stop bar, is located at an infeed side of an infeed table or shelf on the brush chipper. It is situated such that an operator may stop the feed of brush for any reason by pushing the lower feed stop bar toward the brush chipper. Present day feed stop bars are typically pivoted from pivot arms at each end of a control bar. The control bar extends across the infeed end of the infeed table. In the known art, the pivot arms extend upward from the control bar and the axis of rotation is above and toward the outfeed end of the brush chipper more than the control bar.

The force of gravity, aggravated by machine vibrations, tends to force the lower feed stop bar toward its forward position, thereby causing nuisance trips.

The infeed table of a brush chipper is subjected to significant vertical accelerations that occur when loading branches/logs onto the feed table. When a log is dropped onto the table it moves downward, stops and then moves upward. As the downward movement starts the feed table and the feed stop bar are subjected to a negative acceleration, wherein the feed stop bar will tend to rotate clockwise if the pivot axis is to the left of the mass of the feed stop bar as shown in FIGS. 1 and 2 of U.S. patent application Ser. No. 2004/0108397, for example, and would tend to rotate counter-clockwise if the pivot axis was to the right of the mass of the feed stop bar. As the feed table is moving downward, the tires and suspension of the machine are being compressed, and eventually the movement changes direction, and energy stored in the tires and suspension cause the machine to move upwards. During this upward movement, when the direction is reversed, the feed stop bar is subject to acceleration in an opposite direction. Having the design of the feed stop bar, including the position of the pivot axis to the left of the mass of the stop bar, as shown in FIGS. 1 and 2 of No. U.S. patent application Ser. No. 2004/0108397, has been observed to result in false trips due to the dynamic loading, the acceleration of the feed table previously described.

U.S. Pat. No. 5,692,548 by Bouwers et al. and U.S. Pat. No. 5,692,549 by Eggers are hereby incorporated by reference and disclose brush chippers having many components of the brush chippers on which the present invention is used. Some of the pertinent components are: a material inlet, or feed table assembly, a plurality of feed rollers, and a chipping drum. The feed rollers are driven by hydraulic motors.

There is, therefore, a need for a method and apparatus for a lower feed stop bar pivoted and oriented in a fashion to reduce the possibility of nuisance trips while providing all the functionality of lower feed stop bars in the prior art.

BRIEF SUMMARY OF THE INVENTION

It is an object of the present invention is to provide a lower feed stop bar for a brush chipper having fewer nuisance trips than lower stop bars of the prior art. To effect this object, the lower feed stop bar is provided with an axis of rotation or pivot located below the control bar and towards the brush chipper relative to the control bar. Configured in this fashion, the center of mass of the lower feed stop bar resides away from the brush chipper relative to the axis of rotation. Hence, gravity tends to rotate the lower feed stop bar in a direction opposite that under which the brush feed will be caused to cease.

In the preferred embodiment, a spring or other elastic member provides further force to rotate the lower feed stop bar in a direction opposite that under which the brush feed will be caused to cease.

An additional object of this invention is to provide a mechanical safety system that positions the lower feed stop bar in its tripped position when the infeed table is folded up into its folded position against the brush chipper. The infeed table is often placed in its folded position for transport of the brush chipper from one area to another. By assuring the feed has ceased, the brush chipper is in a safer and more efficient mode for transport.

The stated and other objects will be made clear by reference to the drawings and detailed description of the invention.

The present invention has resulted in an unexpected result of having fewer false trips. This is believed to be due to the fact that positive acceleration of the feed table, as it stops moving downward, and starts moving upward, is greater than the negative acceleration as it initially moves downward.

One significant aspect of the preferred embodiment of the present invention is the fact that the machine is mounted on a trailer with a suspension and with rubber tires. It is theorized that this is the reason that the maximum acceleration occurs when the feed table changes direction from downward to upward following a log being dropped on the infeed table and this is at least partially why this invention is effective.

DETAILED DESCRIPTION OF THE INVENTION

Figure 1:
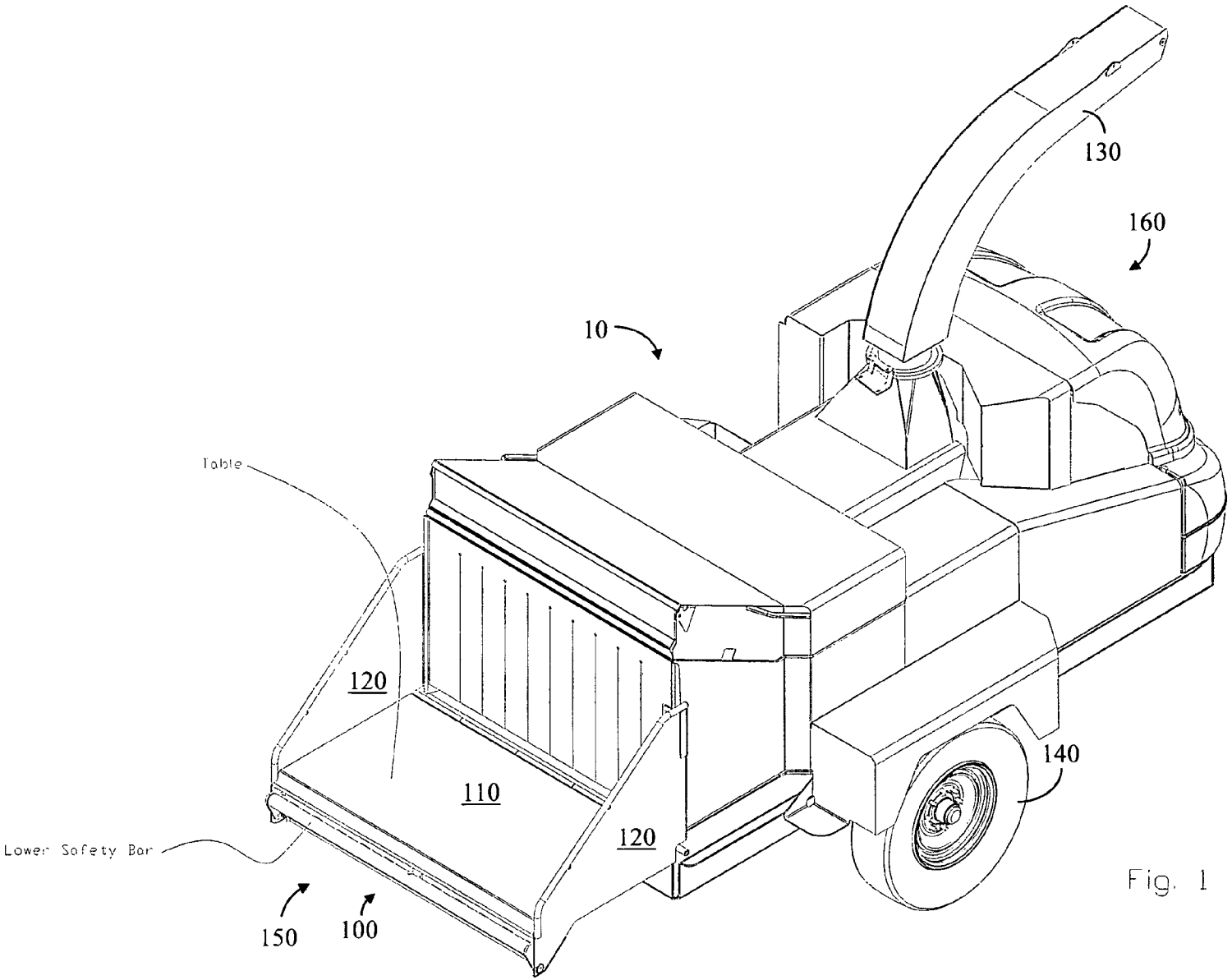
FIG. 1 is an isometric of a brush chipper with a feed table in a lowered position.

With reference now to the various figures in which identical elements are numbered identically throughout, a description of various exemplary aspects of the present invention will now be provided. The preferred embodiments are shown in the drawings and described with the understanding that the present disclosure is to be considered an exemplification of the invention and is not intended to limit the invention to the embodiments disclosed.

Figure 2:
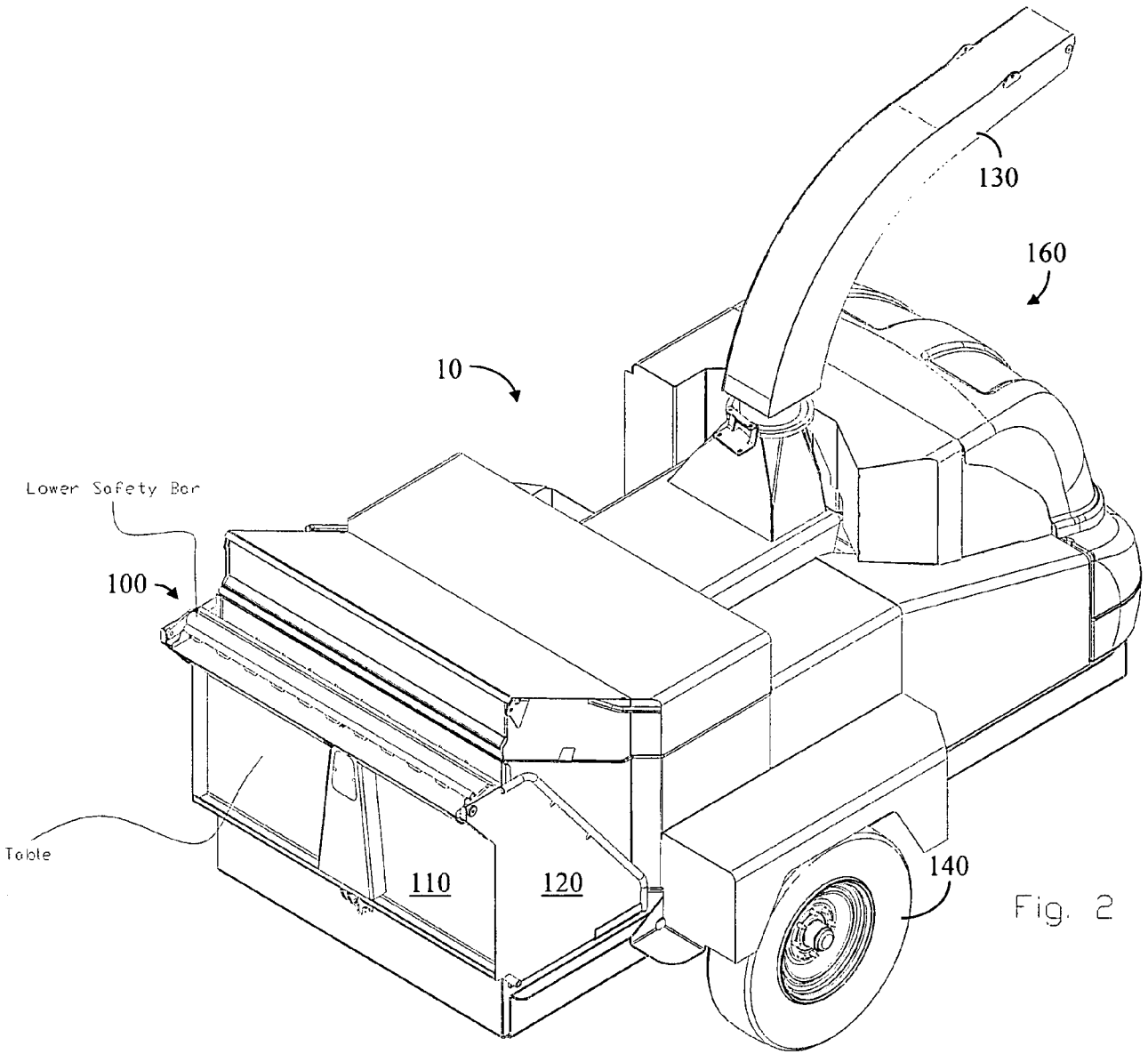
FIG. 2 is an isometric of the brush chipper with the feed table in a raised position.

A brush chipper 10, illustrated with the lower feed stop bar 100 of the present invention, is shown in FIGS. 1 and 2. Besides the lower feed stop bar 100, the brush chipper comprises a feed table 110 having perpendicular sides 120 for structural support and for guiding brush into the brush chipper 10. As illustrated in published U.S. patent application Ser. No. 2004/0108397, which is hereby incorporated in its entirety by reference, inside the brush chipper 10 are two feed rollers to force the brush into the brush chipper.

Once the brush has been chipped into wood chips, the resulting wood chips are expelled through a rotatable chute 130.

The brush chipper is often mounted on wheels 140 (only one shown in FIGS. 1 and 2), as shown, however, tracks and skids may also be used, and the brush chipper 10 may be stationary as well. The present invention is not limited to any particular conveyance apparatus, nor does it require the brush chipper 10 be portable.

Generally, the brush chipper 10 has an infeed end 150 and an outfeed end 160. A feed direction is defined, for the purposes of this document, including the claims, as the direction the brush is forced while it is being chipped; that is, the feed direction is the direction going from the infeed end to the outfeed end of the brush chipper.

Figure 3:
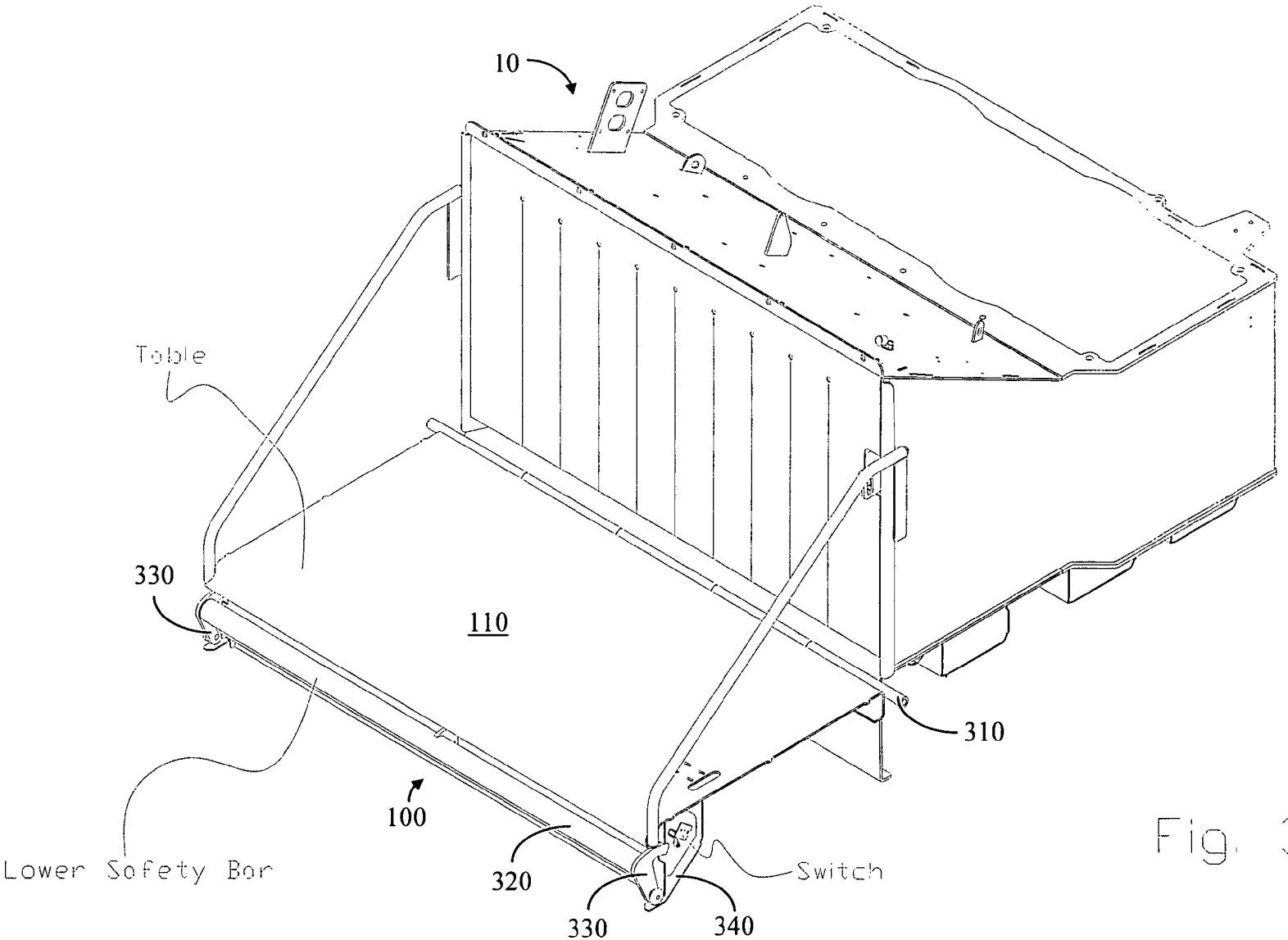
FIG. 3 is an isometric of the feed table with the bottom feed stop bar in a fully extended position.

As is clearly seen in FIG. 3, the feed table 110 is hingedly attached to the brush chipper 10 by a hinge 310. The lower feed stop bar 100 comprises a control bar 320 extending substantially across the infeed end of the feed table 110, and two pivot arms 330 by which the lower feed stop bar 100 is operatively, pivotally attached to flanges 340, which, in turn, are operatively attached to the feed table 110.

Figure 7:
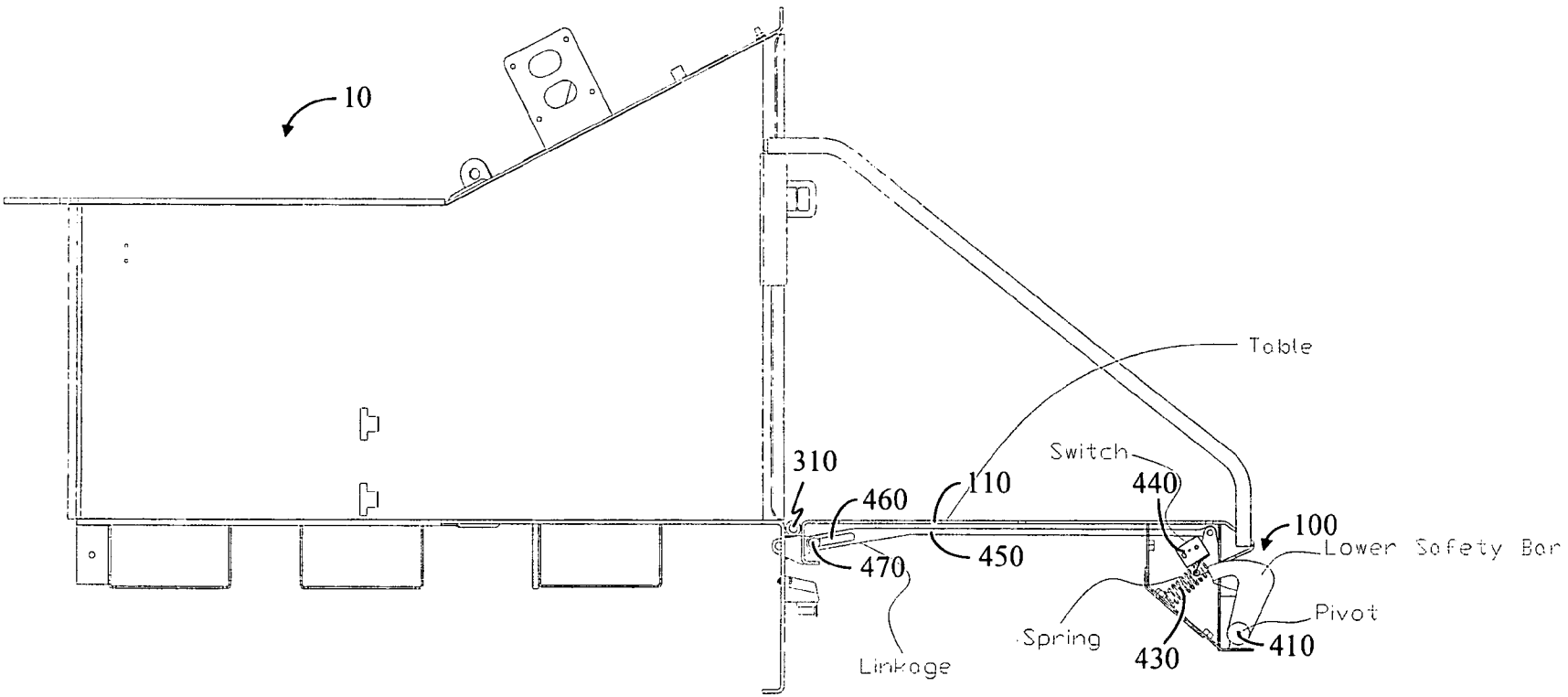
FIG. 7 is a side elevation view of the feed table, the bottom feed stop bar in a normal position, the feed table lowered.
Figure 8:
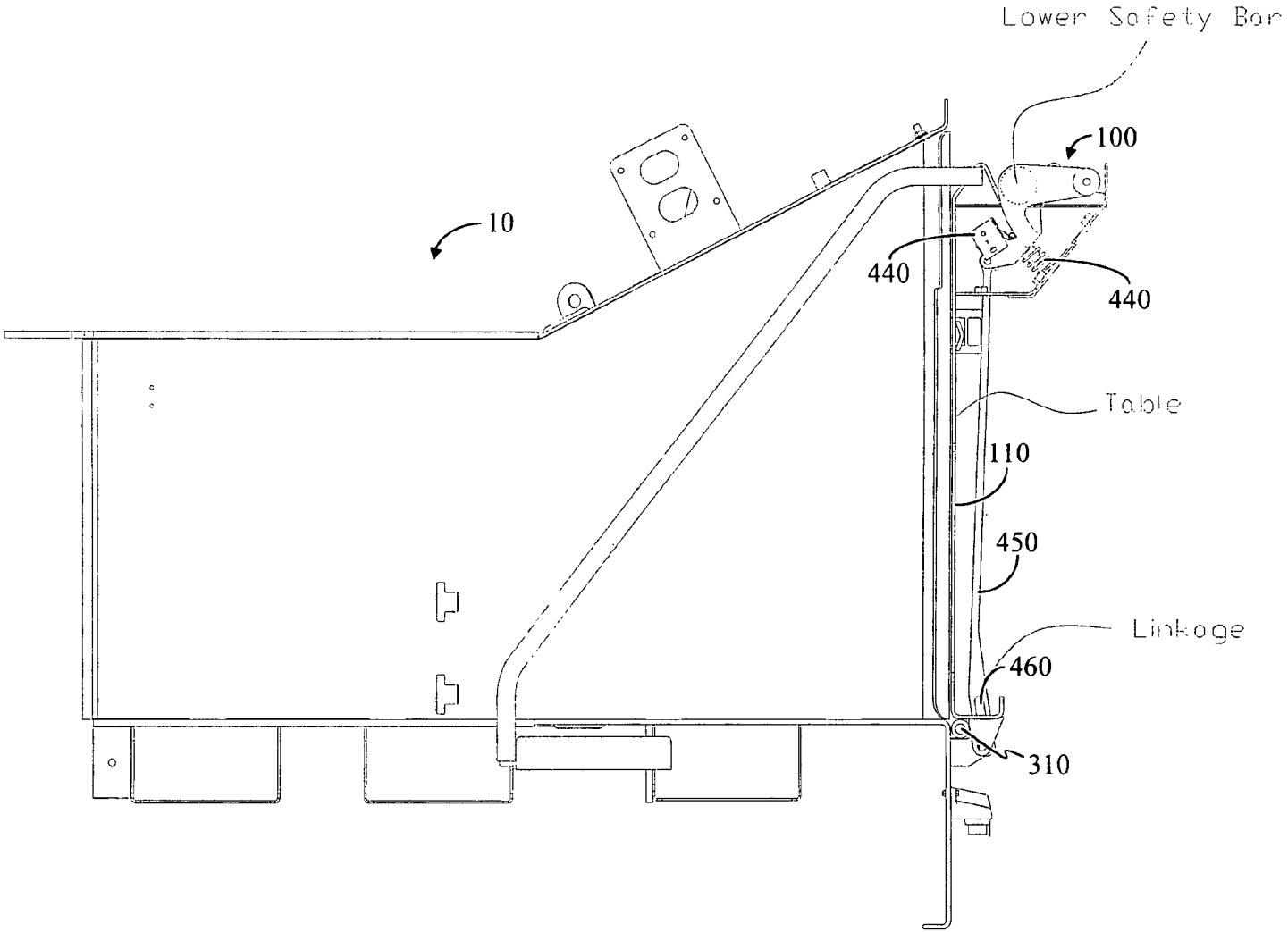
FIG. 8 is a side elevation view of the feed table, the feed table raised to the transport position.

The feed table 110 stows against the brush chipper 10 for transport as seen in FIG. 8. Folding the feed table 110 is effected by pivoting the feed table 110 on its hinge 310. FIG. 7 illustrates the feed table 110 in the position used for chipping brush.

Figure 4:
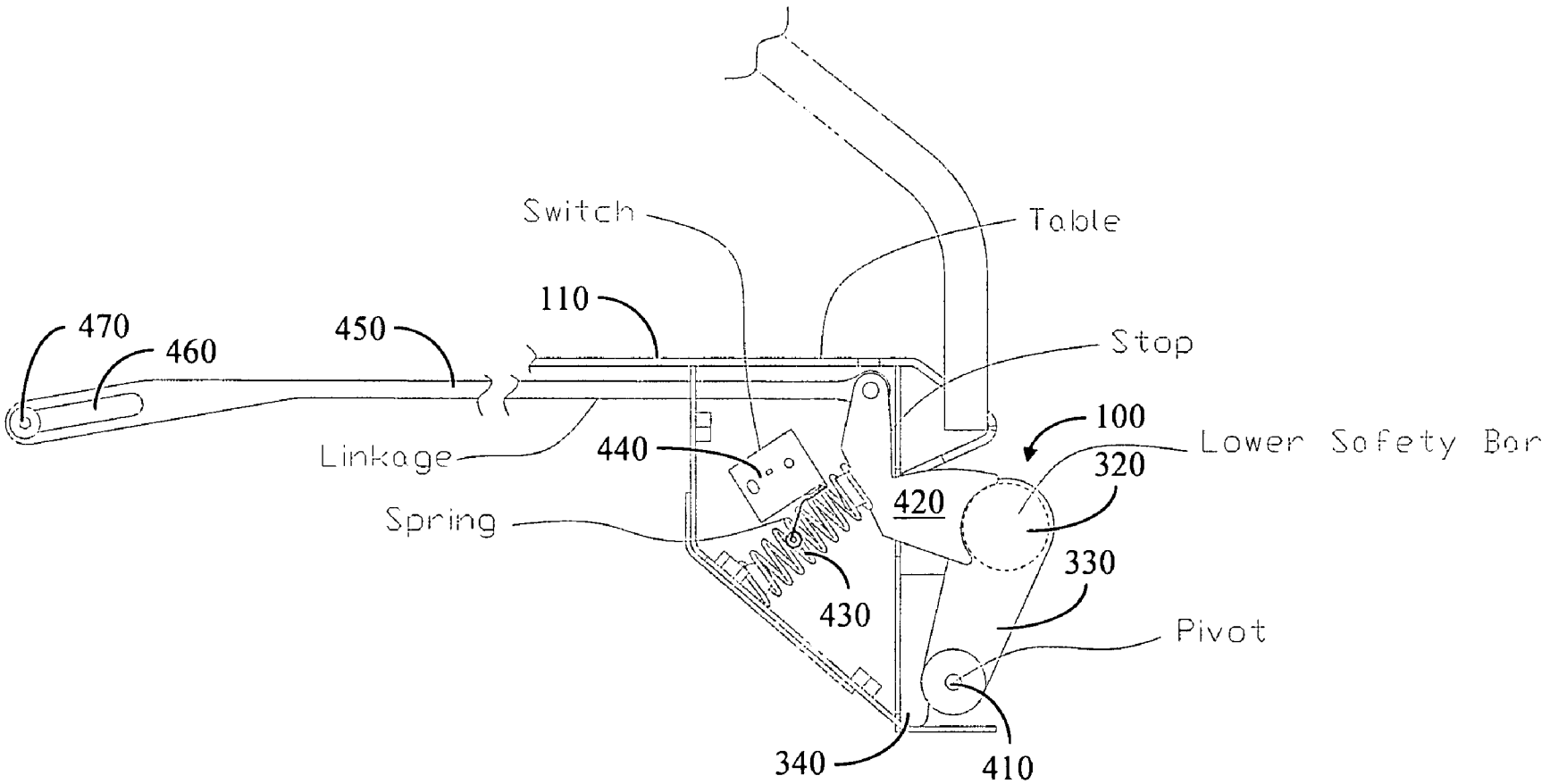
FIG. 4 is a detailed cross section of the bottom feed stop bar in the fully extended position showing a spring.
Figure 5:
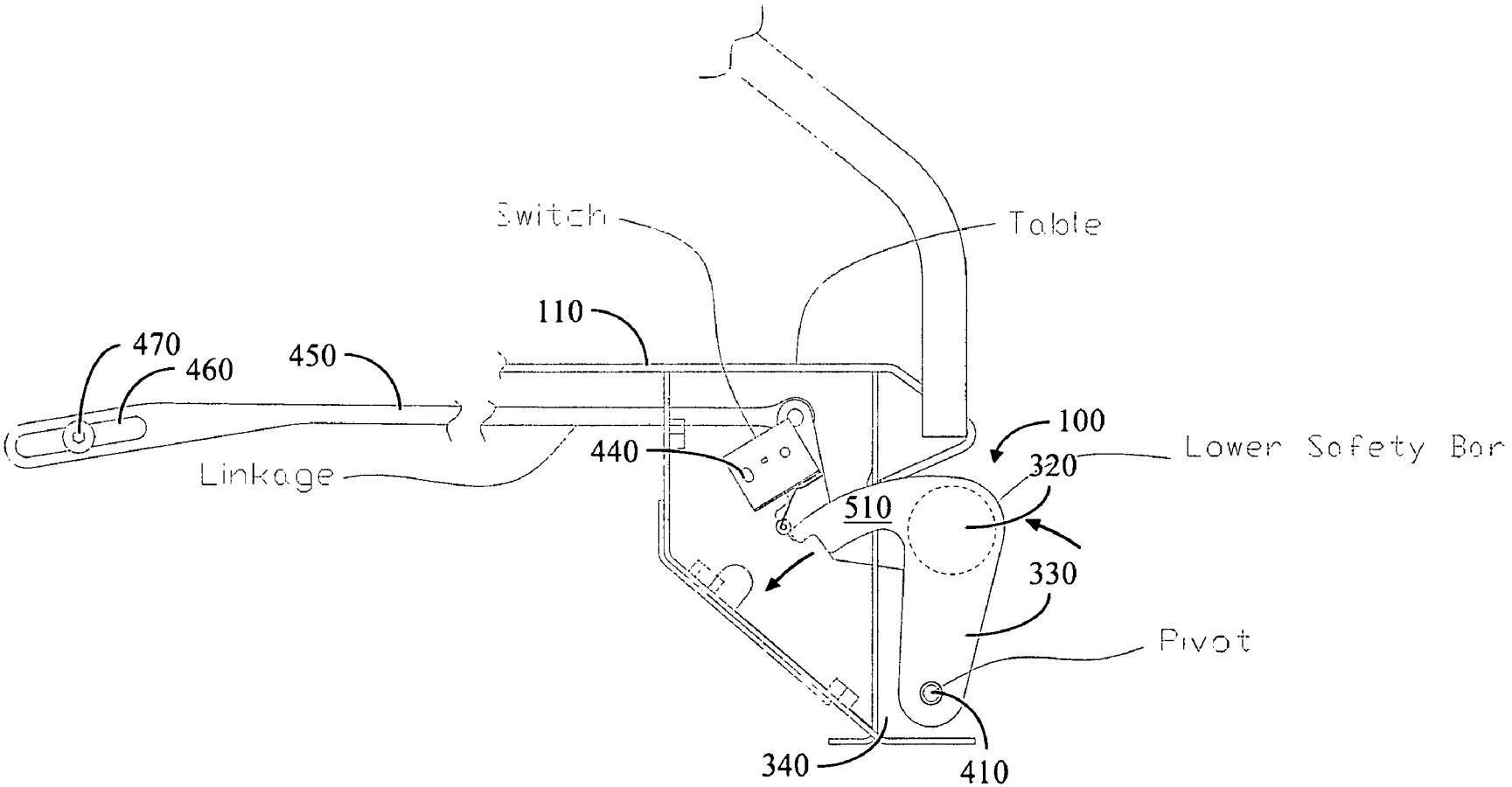
FIG. 5 is a detailed cross section of the bottom feed stop bar in a normal sensitivity position with the spring deleted, showing a switch.
Figure 6:
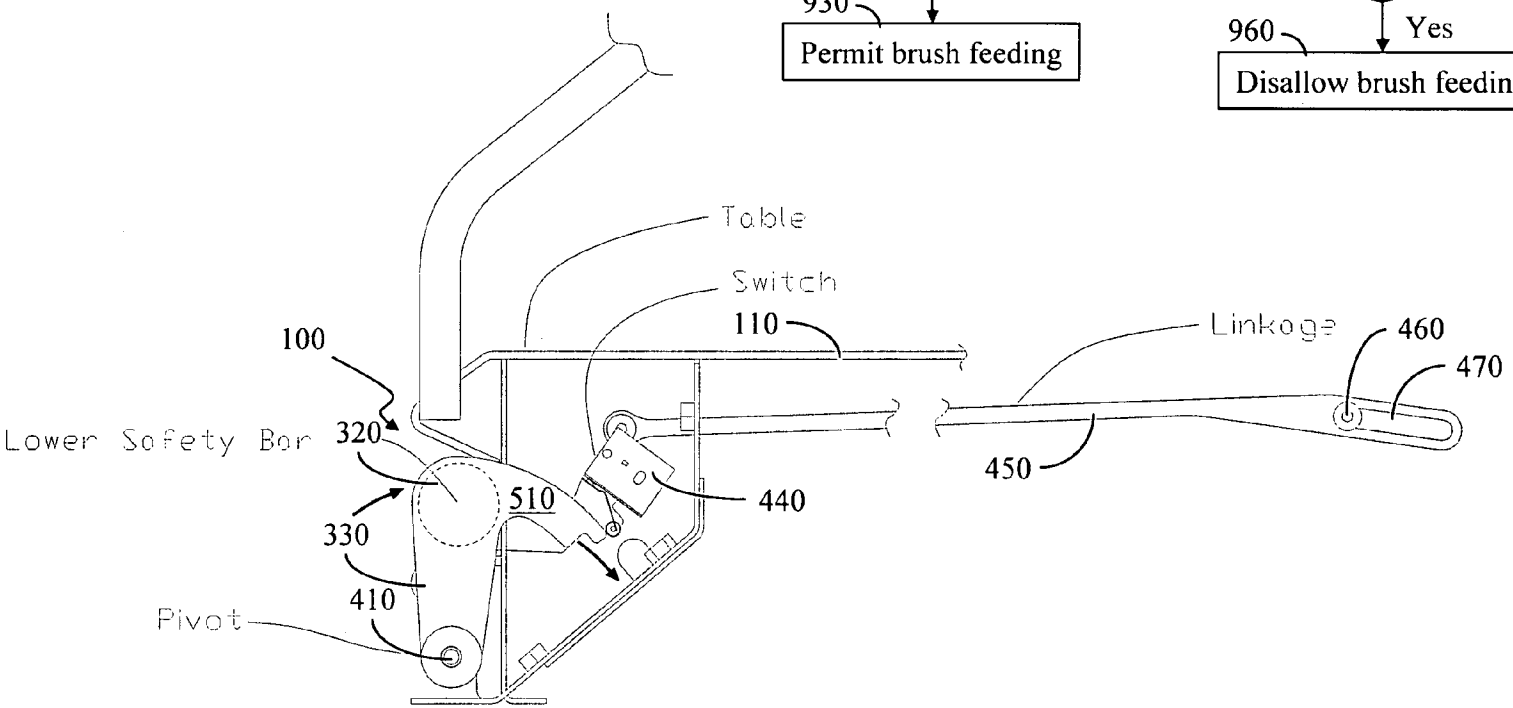
FIG. 6 is a detailed cross section of the bottom feed stop bar in a reduced sensitivity position with the spring deleted, showing the switch.

Detail views of the lower feed stop bar 100 are shown in FIGS. 4-6. The pivot arms 330 (only one visible) are operatively, pivotally attached at an axis of rotation 410 to the flanges 340 (only one visible). The pivot arms 330 are rigidly attached or integral with the control bar 320. Hence, the lower feed stop bar 100 assembly, comprising the control bar 320 and the flanges 330, rotates about the axis of rotation 410.

The control bar 320 engages a movable stop 420, which, in turn, engages a spring 430. Thus, the movable stop 420 can be forced into the spring and moved, yet still provides a force to maintain the lower feed stop bar in an untripped position as shown in FIG. 4. An adequate force in the infeed direction, that is, to the left in FIG. 4, will cause the feed stop bar 100 to rotate about its axis of rotation 410 against a force of the spring 430.

Preferably connected to or integral with the pivot arm 330 is a curved finger 510 made to engage a normally closed switch 440, the switch providing a signal to keep the brush feed rollers turning. When the curved finger 510 engages the switch 440, as shown in FIGS. 5 and 6, the switch contacts open, thus causing the brush rollers to cease turning.

A link arm 450 is pivotally connected to the stop 420 at a first end. A second end, having a slot 460, is pivotally, slidably engaged to a pivot 470, as seen in FIGS. 7 and 8. When the feed table 110 is down in its operating position, as shown in FIG. 7, the stop 420 is allowed to move horizontally because the pivot 470 is free to slide in the slot 460. In FIG. 4, the lower feed stop bar 100 is in operating position, and the pivot 470 is seen to be against the distal end of the slot 460 in the second end of the link arm 450.

In FIG. 5, the lower feed stop bar 100 has been pushed in the feed direction, that is, to the left in the orientation shown in FIG. 5. The finger 510 has just begun to engage the switch 440. . The pivot 470 is seen to be between the ends of the slot 460 at this position of the feed stop bar 100. Although the spring 430 is not shown in FIG. 5, it is in a partially compressed condition when the feed stop bar 100 is in the position shown in FIG. 5.

The lower feed stop bar 100 is shown in its most depressed position in FIG. 6. The proximal end of the slot 460 in the link arm 450 has reached the pivot 470 due to the extent by which the lower feed stop bar 100 has been forced in the feed direction, in other words, to the right in FIG. 6.

An additional feature of the instant invention is shown in FIG. 6 wherein the switch 440 may reside in a plurality of positions in the feed direction. In the preferred embodiment, the switch 440 may take two positions: a first position for normal sensitivity of the feed stop action, and a second position, displaced from the first position in the feed direction, wherein the sensitivity is reduced compared to the normal sensitivity of the first position. Clearly, when the switch is in the second position, shown in FIG. 6, the lower feed stop bar 100 must be rotated about the axis of rotation 410 to a greater extent than if the switch 440 is in the first position, as shown in FIGS. 4 and 5.

An additional feature of the present invention is seen by comparing FIGS. 7 and 8. When the feed table 110 is in its lowered position as shown in FIGS. 1 and 3-7, as explained above, the lower feed stop bar 100 is forced toward the infeed end 150 of the brush chipper 10 by the spring 430. Sufficient travel toward the infeed end 150 is permitted by the slot 460 in the link arm 450 because the distance between the pivot 470 and the switch 440 is such that the lower feed bar 100 can extend away from the switch 440. When the feed table 110 is in its raised position as shown in FIGS. 2 and 8, the distance between the pivot 470 and the switch 440 is greater than when the feed table 110 was in its lowered position. Hence, the link arm 450 is pulled toward the pivot 470 and sufficient force is applied to the spring 430 to engage the finger 510 to the switch 440, thereby disallowing the feed mechanisms to operate as long as the feed table 110 is in its raised position. Preferably, the feed table 110 is in its raised position during transport of the brush chipper 10.

Figure 9:
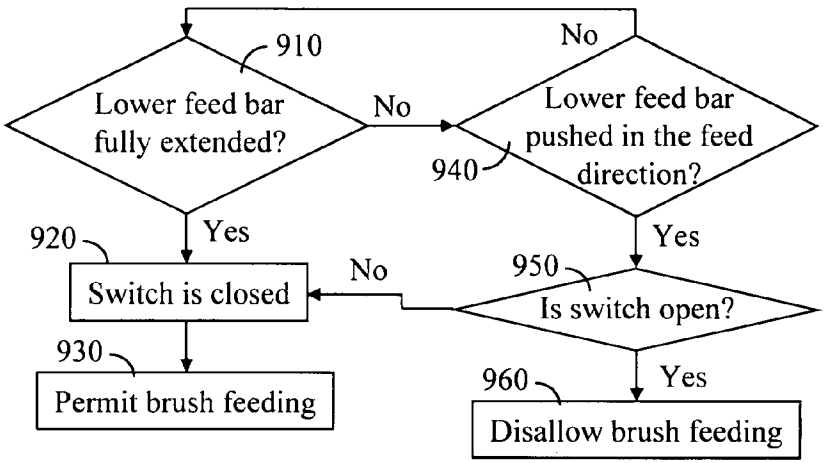
FIG. 9 is a flow chart showing logic for controlling a feed of the brush chipper with the lower feed stop bar.

A flow chart of the logic of control with the lower feed stop bar 100 is shown in FIG. 9 and is largely self explanatory. If the lower feed stop bar 100 is fully extended 910 in toward the infeed end of the brush chipper 10, the switch 440 is closed 920 and brush feeding is permitted 930 if the operator desires. If, on the other hand, the lower feed stop bar 100 is pushed in the feed direction 940, it must be pushed sufficiently far to engage the switch 440. The required distance the lower feed stop bar 100 must be pushed is dictated by whether the switch 440 is located in the normal sensitivity position, or the reduced sensitivity position. If the switch is engaged and, thus, open 950, the feed mechanisms in the brush chipper 10 are disallowed from feeding brush 960.

The above embodiment is the preferred embodiment, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

The invention claimed is:

1. A method of providing a lower stop bar on a machine having an infeed end and an outfeed end and further comprising a feed table, the lower stop bar comprising a control bar and a pivot arm, the method comprising:

(a) operatively, affixing the pivot arm to the control bar;

(b) operatively, pivotally connecting the pivot arm to the feed table near the infeed end at an axis of rotation; and (c) orienting the control bar and the pivot arm such that the axis of rotation is lower than the control bar.

2. The method of claim 1 additionally comprising orienting the control bar and the pivot arm such that the axis of rotation is closer to the outfeed end of the brush chipper than the control bar.

3. The method of claim 1 additionally comprising:

(a) pushing the control bar toward the outfeed end of the brush chipper; and (b) engaging a switch with the lower feed stop bar to halt an infeed of brush into the brush chipper.

4. The method of claim 1 additionally comprising providing a force to the lower feed stop bar toward the infeed end of the brush chipper.

5. The method of claim 4 wherein the force is provided by an elastic element.

6. The method of claim 5 wherein the elastic element comprises a spring.

7. The method of claim 1 additionally comprising:

(a) operatively, pivotally connecting the feed table to the brush chipper such that, the feed table may fold up against the brush chipper;

(b) operatively connecting a link arm to the lower feed stop bar;

(c) folding the feed table up against the brush chipper to a folded position; and (d) maintaining the lower feed stop bar in a position to disable the brush chipper while the feed table is in the folded position.

8. The method of claim 7 wherein operatively connecting the link arm to the lower feed stop bar comprises operatively connecting a first end of the link arm to the lower feed stop bar and wherein maintaining the lower feed stop bar in the position to disable the brush chipper comprises:

(a) engaging a second end of the link arm to a pivot, said pivot being a first distance from the axis of rotation when the feed table is in a lowered position; and (b) increasing said distance between the pivot and the axis of rotation when the feed table is raised to the folded position.

9. A method of providing a lower stop bar on a machine having an infeed end and an outfeed end and further comprising a feed table, the lower stop bar comprising a control bar and a pivot arm and a center of mass, the method comprising:

(a) operatively affixing the pivot arm to the control bar;

(b) operatively, pivotally connecting the pivot arm to the feed table near the infeed end at an axis of rotation;

(c) providing a trip direction of rotation of the lower feed stop bar on the axis of rotation such that, if the lower feed stop bar is rotated in the trip direction of rotation, a brush feed into the brush chipper is ceased; and (d) locating the center of mass of the lower feed stop bar relative to the axis of rotation such that gravity tends to rotate the lower feed stop bar about the axis of rotation in a non-trip direction.

10. The method of claim 9 further comprising subjecting the infeed table to significant vertical accelerations by loading logs onto the feed table causing the feed table to move downward, stop and move upward, wherein the feed stop bar would tend to rotate in a first direction if the axis of rotation was to a first side of the center of mass of the feed stop bar, and would tend to rotate in a second direction if the axis of rotation was to a second side of the center of mass with respect to the feed stop bar.

11. The method of claim 9 further comprising:

(a) placing a heavy portion of a tree on the feed table;

(b) causing a negative acceleration as the feed table moves downward, said negative acceleration having a magnitude;

(c) causing a positive acceleration of the feed table as the feed table moves upward due to reactive forces from a trailer suspension and/or rubber tires operatively attached to the feed table, said positive acceleration having a lesser magnitude than the magnitude of the negative acceleration.

* * * * *